United States Patent [19]

Fish

[11] Patent Number: 4,469,498

[45] Date of Patent: Sep. 4, 1984

[54] DIRT INTERCEPTOR FILTER BAG MOUNT FOR VACUUM CLEANER

[75] Inventor: Warren H. Fish, Ramsey County

[73] Assignee: Whirlpool Corporation, Benton Harbor, Mich.

[21] Appl. No.: 428,416

[22] Filed: Sep. 29, 1982

[51] Int. Cl.[3] ..... B01D 50/00; B01D 51/00

[52] U.S. Cl. ..... 55/335; 55/368; 55/374; 55/418; 55/439; 55/462; 55/467; 55/DIG. 3

[58] Field of Search ..... 55/368, 335, 374–378, 55/418, 439, 462, 467, DIG. 3

[56] References Cited

U.S. PATENT DOCUMENTS

| | | | |
|---|---|---|---|
| 1,311,973 | 8/1919 | Jopson | 55/462 |
| 1,316,442 | 9/1919 | Goughnour . | |
| 1,408,489 | 3/1922 | Tracy . | |
| 2,034,373 | 3/1936 | Bilde | 55/467 X |
| 2,346,339 | 4/1944 | Vose | 55/368 X |
| 2,503,568 | 4/1950 | Timm . | |
| 2,573,556 | 10/1951 | Fain . | |
| 2,639,001 | 5/1953 | Meyerhoefer | 55/376 X |
| 2,674,340 | 4/1954 | Vance . | |
| 2,722,285 | 11/1955 | Brace . | |
| 2,848,063 | 8/1958 | Meyerhoefer . | |
| 3,112,511 | 12/1963 | Lankenau . | |
| 3,343,344 | 9/1967 | Fairaizl et al. | 55/376 |
| 3,618,297 | 11/1971 | Hamrick . | |
| 3,675,399 | 7/1972 | Westergren . | |
| 3,749,130 | 7/1973 | Howitt et al. | 55/418 X |
| 3,812,659 | 5/1974 | Westergren et al. . | |
| 3,820,310 | 6/1974 | Fromknecht et al. | 55/467 X |
| 3,921,250 | 11/1975 | Jerabek . | |
| 3,973,936 | 8/1976 | Howard et al. . | |

FOREIGN PATENT DOCUMENTS

| | | | |
|---|---|---|---|
| 694801 | 8/1940 | Fed. Rep. of Germany | 55/368 |
| 1526871 | 5/1968 | France | 55/462 |

*Primary Examiner*—Kathleen J. Prunner

*Attorney, Agent, or Firm*—Wood, Dalton, Phillips, Mason & Rowe

[57] ABSTRACT

A connector for connecting a filter bag to the suction inlet of a vacuum cleaner. The filter bag connector includes a dirt interceptor extending across the air flow path from the suction inlet to intercept high speed dirt particles at the center and upper center portion of the air flow path, absorb kinetic energy therefrom, and deliver the intercepted dirt particles into the substantially unimpeded lower and side portions of the air flow path for delivery with the slower moving dirt particles therein freely into the filter bag. Resultingly, abrasion of the filter bag is effectively minimized for providing extended useful life of the filter bag. In the illustrated embodiment, the dirt interceptor includes an upper flat portion and a lower flat portion extending at different angles to the perpendicular to the flow path. In the illustrated embodiment, the dirt interceptor tapers across its width and in thickness toward the distal end thereof.

13 Claims, 4 Drawing Figures

DIRT INTERCEPTOR FILTER BAG MOUNT FOR VACUUM CLEANER

BACKGROUND OF THE INVENTION

1. Field of the Invention

This invention relates to vacuum cleaners and in particular to means for mounting the filter bag to the suction inlet of a vacuum cleaner.

2. Description of the Background Art

In one form of vacuum cleaner, a filter bag is provided within a canister for receiving the dirt-laden air drawn by the suction means of the vacuum cleaner through a suction inlet of the canister to which may be connected a hose connected in turn, to a pickup wand connected to a floor cleaning tool, or the like. The filter bag conventionally comprises a throw-away bag which may be made of an abrasion susceptible material, such as paper or the like. It has been found that a problem arises in the use of such abrasion-susceptible filter bags in that sharp dirt particles and the like entrained in the dirt-laden air stream tend to cut or abrade the bag, shortening its useful life.

It is further conventional in such canister-type vacuum cleaners to provide a filter bag connector adapter to which the mouth of the filter bag is connected and which, in turn, provides a removable connection to the vacuum cleaner structure so as to place the mouth of the filter bag in air-receiving relationship to the suction inlet means. In one form, the filter bag adapter includes a front wall portion which is slid into suitable mounting slots on the canister housing at opposite sides of the suction inlet to effect the desired mounting of the bag in alignment with the suction inlet for receiving the dirt-laden air therefrom.

An excellent example of such a vacuum cleaner construction is shown in U.S. Pat. No. 3,675,399 of George A. Westergren, which patent is owned by the assignee hereof. As shown therein, the dirt separating filter bag is releasably attached to an adapter which itself is releasably supported on a bracket to provide air flow access into the filter member. The adapter is arranged to be readily removed from the vacuum cleaner when it is desired to attached a new filter member thereto, permitting a dirt-filled bag to be discarded as desired.

Another vacuum cleaner structure utilizing a filter bag adapter is illustrated in U.S. Pat. No. 3,812,659, of George A. Westergren et al, which patent is also owned by the assignee hereof. As shown therein, an adapter is provided for connecting the filter bag to the suction inlet. A locking member is secured to the vacuum cleaner base for releasably retaining the filter bag adapter in the cannister and concurrently locking a hose latch to the base.

A number of bag-mounting adapters have been developed over the years utilizing deflector portions at the inner end thereof. Illustrative of such devices is that shown in U.S. Pat. No. 1,316,442 of C. L. Goughnour wherein a deflector is mounted to the wall of the housing inwardly of the suction inlet.

In U.S. Pat. No. 1,408,489 of Pratt E. Tracy, a bag-holding means is illustrated having an inner directing lip for turning the air stream into a downwardly extending receiving bag.

In U.S. Pat. No. 2,722,285, George A. Brace discloses a filter assembly having a combined air deflector and filter pilot having a large discharge opening directed toward an inlet into the main body portion of the disposable filter bag.

SUMMARY OF THE INVENTION

The present invention comprehends an improved means for connecting a filter bag to the suction inlet of a vacuum cleaner including a dirt interceptor arranged to intercept the relatively high speed particles entrained in the suction air at the center and upper center portions of the air flow path from the suction inlet and delivering the intercepted particles into the slower moving suction air delivered along the bottom and sides of the suction inlet for effectively minimizing abrasion of the filter bag and substantially extending the useful life thereof.

More specifically, the invention comprehends the provision of such a filter bag connector including an annular wall means having an outlet end, and an inlet end provided with means for removably mounting the wall means to the suction inlet, a connection portion defining means for removably connecting the mouth of a filter bag thereabout for delivery of dirt-laden air from the suction inlet into the filter bag, and a dirt interceptor on the outlet end of the wall means extending diametrically across the air flow path defined by the outlet end, the dirt interceptor being joined to the annular wall means at an upper portion thereof to extend downwardly across a major portion of the air flow path and less than fully thereacross, whereby slower moving entrained dirt particles and suction air being delivered along the bottom and sides of the inner surface of the suction inlet are permitted free movement into a connected bag while more rapidly moving entrained dirt particles at the center and upper portion above the center of the air flow path are intercepted and delivered into the slower moving air for delivery with the slower moving dirt particles into the bag for effectively minimizing abrasion of the filter bag in use and extending the useful life thereof.

In the illustrated embodiment, the dirt interceptor comprises means formed integrally with the annular connector wall means, and more specifically, formed as a one-piece unit therewith of molded synthetic resin.

In the illustrated embodiment, the dirt interceptor tapers downwardly from an upper portion of the annular wall means and includes an upper portion extending less than perpendicularly across the air flow path and a lower distal end portion extending at a lesser angle to the perpendicular.

In the illustrated embodiment, the lower distal end portion extends at an angle of approximately half of the angle of the upper portion, and more specifically, in the illustrated embodiment, the lower portion extends at an angle of approximately 10° to the perpendicular.

The dirt interceptor, in the illustrated embodiment, tapers downwardly both in width and thickness.

The dirt interceptor, in the illustrated embodiment, includes a mounting portion extending inwardly from the outlet end of the annular wall means.

In the illustrated embodiment, the several portions of the dirt interceptor comprise substantially flat portion.

The dirt interceptor means of the present invention is extremely simple and economical of construction while yet providing the substantial improvement, features and advantages discussed above.

BRIEF DESCRIPTION OF THE DRAWINGS

Other features and advantages of the invention will be apparent from the following description taken in connection with the accompanying drawing wherein.

DESCRIPTION OF THE PREFERRED EMBODIMENT

Figure 1:
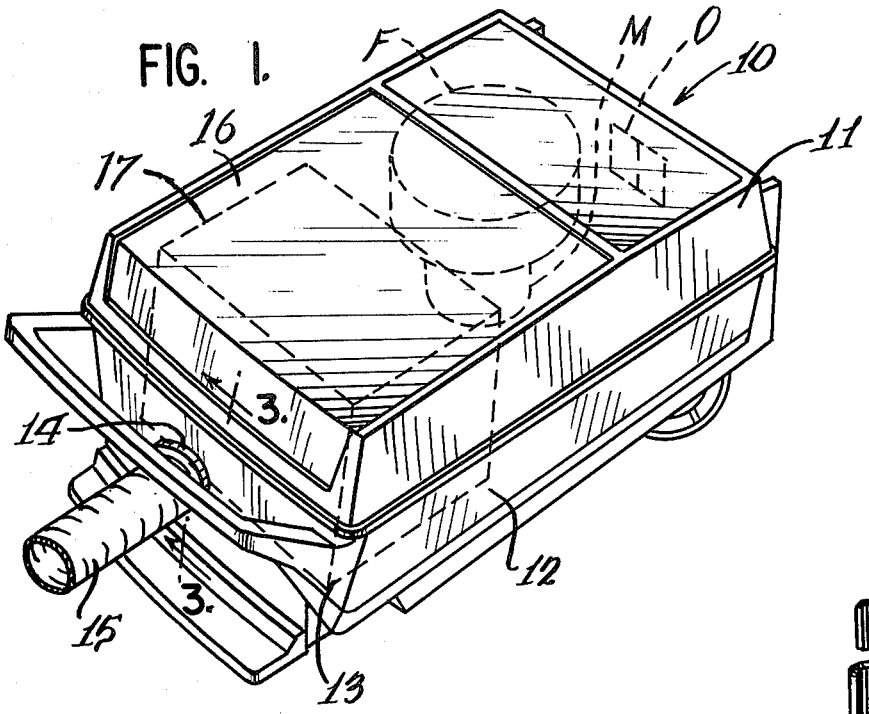
FIG. 1 is a perspective view of a vacuum cleaner canister structure having a filter bag connecting means embodying the invention.

In the illustrative embodiment of the invention as disclosed in the drawing, a vacuum cleaner generally designated 10 includes a canister 11 having a housing 12 provided with a front wall 13 in which is mounted a suction inlet 14 to which is removably connected a suction hose end 15. The canister includes conventional air suction means in the form of a motor M and fan F for drawing dirt-laden air through hose 15 and suction inlet 14 into a suction space 16 within the housing 12, and an air outlet O formed in the rear wall of the canister housing in communication with the high pressure side of the motor and fan assembly M,F. Dirt entrained in the suction air is removed therefrom by flow of the suction air through a filter bag 17 removably connected to the suction inlet 14 by a suitable adapter connector generally designated 18. The present invention is concerned with the provision of dirt interceptor means generally designated 19 in association with the connector 18 for effectively minimizing abrasion and cutting of the bag 17 by sharp dirt particles, etc., entrained in the suction air as it is delivered to the bag.

Figure 2:
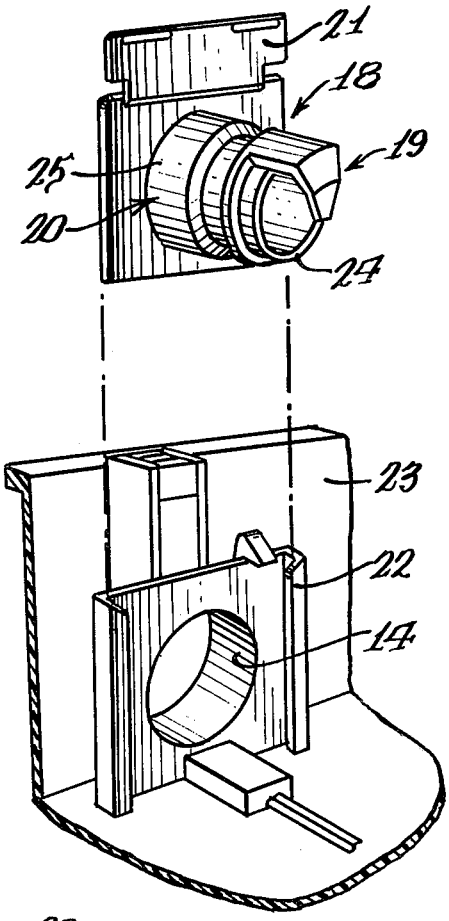
FIG. 2 is a fragmentary exploded perspective view illustrating the removable connection between the filter bag connecting means and mounting means on the vacuum cleaner canister housing.

More specifically, as best seen in FIG. 2, connector 18 includes a mounting portion 20 provided with a slide wall portion 21 adapted to be slidably engaged with a slide bracket 22 mounted on the inner surface 23 of front wall 13 and having a tubular extension projecting outwardly through the front wall and defining the suction inlet 14.

Mounting portion 20 comprises an annular wall having an outlet end 24 and an inlet end 25 to which the slide wall 21 is integrally joined.

Figure 3:
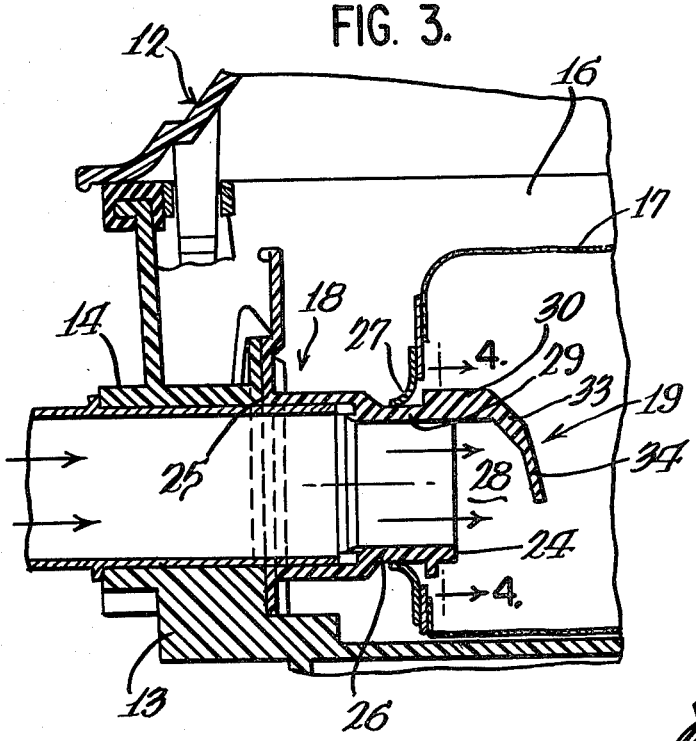
FIG. 3 is a fragmentary elevation section of the vacuum cleaner illustrating in greater detail the construction and operation of the filter bag connecting means.

Connector 18 further includes a connection portion 26 for removable connection thereto of the mouth 27 of the filter bag 17 thereabout for delivery of the dirt-laden air from the suction inlet 14 into the filter bag in suction space 16, as illustrated in FIG. 3.

Figure 4:
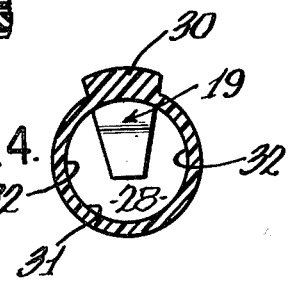
FIG. 4 is a transverse section taken substantially along the line 4—4 of FIG. 3.

Dirt interceptor means 19 is provided on the outlet end 24 of the connector 18 to extend diametrically across the air flow path 28 defined by the outlet end 24 of the connector. As shown in FIGS. 2, 3, and 4, the dirt deflector is joined to the annular wall means at an upper portion 29 thereof to extend downwardly to intercept a major portion of the air flow path 28 while less than fully thereacross. It has been found that the provision of the improved dirt interceptor 19 permits free movement into the bag 17 of slower moving entrained dirt particles and suction air being delivered along the bottom and sides of the inner surface of the suction inlet 14 and connector 18 while causing interception of the more rapidly moving entrained dirt particles at the center and upper portion of the air flow path so as to cause the kinetic energy of the rapidly moving particles to be dissipated and cause delivery thereof into the slower moving air for delivery with the slower moving dirt particles into the bag, thereby effectively minimizing abrasion of the bag in the use of the vacuum cleaner.

As best seen in FIG. 3, the dirt interceptor 19, in the illustrated embodiment, is formed integrally with the annular outlet end portion 24 of connector 18 and, more specifically, the dirt interceptor and bag connector are formed as a one-piece element as by molding thereof from a suitable synthetic resin.

As best seen in FIG. 4, dirt interceptor 19 tapers in width downwardly from a mounting portion 30 joined to the outlet end portion 24 of the connector. As shown, the dirt interceptor extends substantially diametrically from mounting portion 30 a major portion of the diameter of the flow path 28 and less than fully thereacross. Thus, the slower moving air and entrained dirt particles are free to move substantially unimpededly from the lower portion 31 and side portions 32 of the connector into the filter bag while the higher speed dirt particles entrained in the higher speed air at the center and upper portion of the flow path 28 are intercepted by the interceptor means 19 so as to absorb the high kinetic energy thereof and cause the dirt particles to be delivered into the slower moving air from portions 31 and 32 for delivery with the slower moving particles therein to the filter bag with effectively minimized tendency to abrade the bag and thereby provide substantially improved long, useful life thereof.

As shown in FIG. 3, the dirt interceptor 19 further tapers downwardly in thickness from the mounting portion 30. More specifically, the dirt interceptor includes an upper flat portion 33 tapering in thickness downwardly to a lower flat portion 34 defining the distal end of the dirt deflector. The lower portion 34 extends at an angle to the perpendicular to the flow path 28 which is less than the angle of the upper portion 33 to the perpendicular, and as seen in FIG. 3, portion 34 extends at an angle of approximately one-half the angle of the upper portion 33. More specifically in the illustrated embodiment, lower portion 34 extends at an angle of approximately 10° to the perpendicular and upper portion 33 extends at an angle of approximately 20° to the perpendicular. Thus, the connector 18 includes an inlet end 25, a mounting portion 30 extending inwardly from the outlet end portion 24, and an inner interceptor portion 19 turned from the inner end of portion 30.

Thus, the dirt interceptor of the present invention functions primarily to intercept the high speed entrained dirt particles at the center and upper center portion of the air flow path at the inlet to the bag, and rather than deflect the high speed particles and air into a portion of the bag, causes an absorption of the kinetic energy thereof so that the dirt particles may be transferred to the slower moving air from the air flow path portions 31 and 32 below and at opposite sides of the interceptor for low speed delivery thereof into the bag with the resulting minimizing abrasion of the bag by the delivered dirt particles. Thus, the dirt interceptor of the present invention functions in an improved manner, completely different from the conventional deflectors of the background art to provide substantial improvement in filter bag life.

The foregoing disclosure of a specific embodiment is illustrative of the broad inventive concepts comprehended by the invention.

I claim:

1. In a vacuum cleaner structure having means defining a suction inlet and means for sucking dirt-laden air at substantial velocity through said inlet into a filter bag and out through an air outlet wherein the dirt is deposited in the filter bag, improved means for connecting the filter bag to said suction inlet comprising annular wall means having an outlet end, and an inlet end provided with means for removably mounting the wall means to said suction inlet, a connection portion defining means for removably connecting a mouth of the filter bag thereabout for delivery of dirt-laden air from the suction inlet into the filter bag, and a dirt interceptor on said outlet end of the wall means extending fixedly diametrically across the air flow path defined by said outlet end, said dirt interceptor having a width less than that of said outlet end and being joined to said annular wall means at an upper portion thereof only to extend downwardly therefrom across a major portion of said air flow path and less than fully transversely across the width of said flow path, whereby slower moving entrained dirt particles and suction air being delivered along the bottom and sides of the inner surface of the suction inlet are permitted free movement into the connected bag while more rapidly moving entrained dirt particles at the center of the air flow path and upper portion above the center of the air flow path are intercepted and delivered into the slower moving air at the sides and lower end of the dirt interceptor for delivery with the slower moving dirt particles into the bag for effectively minimizing abrasion of the filter bag in use and extending the useful life thereof.

2. The vacuum cleaner structure of claim 1 wherein said dirt interceptor comprises means formed integrally with said annular wall means.

3. The vacuum cleaner structure of claim 1 wherein said dirt interceptor tapers downwardly.

4. The vacuum cleaner structure of claim 1 wherein said dirt interceptor includes an upper portion extending less than perpendicularly across the air flow path, and a lower distal end portion extending at a lesser angle to the perpendicular.

5. The vacuum cleaner structure of claim 1 wherein said dirt interceptor includes an upper portion extending less than perpendicularly across the air flow path, and a lower distal end portion extending at a lesser angle to the perpendicular, said upper portion having a greater thickness than said lower distal end portion.

6. The vacuum cleaner structure of claim 1 wherein said dirt interceptor includes an upper portion extending less than perpendicularly across the air flow path and having a greater width transversely across the air flow path than the width of the lower distal end portion of said interceptor.

7. The vacuum cleaner structure of claim 1 wherein said dirt interceptor includes a mounting portion extending inwardly from said outlet end of said annular wall means and an inner interceptor portion turned from an inner end portion of the connection portion.

8. The vacuum cleaner structure of claim 1 wherein said dirt interceptor includes a mounting portion extending inwardly from said outlet end of said annular wall means and an inner interceptor portion turned from an inner end portion of the connection portion, said connection portion being disposed intermediate said interceptor mounting portion and said wall means outlet end.

9. The vacuum cleaner structure of claim 1 wherein said annular wall means and dirt interceptor comprise a one-piece molded element formed of a synthetic resin.

10. The vacuum cleaner structure of claim 1 wherein said dirt interceptor includes a substantially flat upper portion extending less than perpendicularly across the air flow path, and a lower substantially flat distal end portion extending at a lesser angle to the perpendicular, said upper portion having a greater thickness than said lower distal end portion and a greater width transversely across the air flow path than the width of said lower distal end portion.

11. The vacuum cleaner structure of claim 10 wherein said dirt interceptor further includes a mounting portion extending inwardly from said outlet end of said annular wall means, said upper portion being connected to an inner end of said mounting portion.

12. The vacuum cleaner structure of claim 1 wherein said dirt interceptor includes an upper substantially flat portion extending at a first angle to the perpendicular across said air flow path, and a lower substantially flat distal end portion extending at an angle to the perpendicular of approximately one-half the angle of said upper flat portion.

13. The vacuum cleaner structure of claim 1 wherein said dirt interceptor includes an upper substantially flat portion extending at an angle of approximately 20° to the perpendicular across said air flow path, and a lower substantially flat distal end portion extending at an angle of approximately 10° to said perpendicular.

* * * * *